US009046313B1

(12) United States Patent
Lutton et al.

(10) Patent No.: US 9,046,313 B1
(45) Date of Patent: Jun. 2, 2015

(54) ADJUSTABLE MODULAR TRIGGER ASSEMBLY FOR FIREARMS

(71) Applicant: O.F. MOSSBERG & SONS, INC., North Haven, CT (US)

(72) Inventors: William C. Lutton, Winsted, CT (US); Charles Olsen, Milford, CT (US)

(73) Assignee: O.F. Mossberg & Sons, Inc., North Haven, CT (US)

( * ) Notice: Subject to any disclaimer, the term of this patent is extended or adjusted under 35 U.S.C. 154(b) by 0 days.

(21) Appl. No.: 14/096,645

(22) Filed: Dec. 4, 2013

(51) Int. Cl.
*F41A 19/00* (2006.01)
*F41A 17/46* (2006.01)
*F41A 19/16* (2006.01)

(52) U.S. Cl.
CPC ..... *F41A 17/46* (2013.01); *F41A 19/16* (2013.01)

(58) Field of Classification Search
CPC ..... F41A 17/46; F41A 17/82; F41A 19/10; F41A 19/15; F41A 19/16; F41A 19/42; F41A 19/43
See application file for complete search history.

(56) References Cited

U.S. PATENT DOCUMENTS

| | | | | |
|---|---|---|---|---|
| 2,126,076 | A * | 8/1938 | Wright et al. | 42/69.02 |
| 2,249,232 | A | 7/1941 | Smith | |
| 4,667,429 | A | 5/1987 | Perazzi | |
| 4,671,005 | A | 6/1987 | Jewell | |
| 4,691,461 | A | 9/1987 | Behlert | |
| 4,908,970 | A | 3/1990 | Bell | |
| 5,012,604 | A | 5/1991 | Rogers | |
| 5,487,233 | A | 1/1996 | Jewell | |
| 6,131,324 | A | 10/2000 | Jewell | |
| 6,164,001 | A | 12/2000 | Lee | |
| 6,553,706 | B1 | 4/2003 | Gancarz et al. | |
| 6,722,072 | B1 | 4/2004 | McCormick | |
| 6,978,568 | B2 | 12/2005 | Jewell | |
| 7,047,685 | B2 | 5/2006 | Diaz et al. | |
| 7,165,352 | B2 | 1/2007 | Langlotz | |
| 7,293,385 | B2 | 11/2007 | McCormick | |
| 8,220,193 | B1 | 7/2012 | Lynch | |
| 8,250,799 | B2 | 8/2012 | Duperry et al. | |
| 2005/0183311 | A1 * | 8/2005 | Diaz et al. | 42/69.01 |
| 2005/0188580 | A1 * | 9/2005 | Jewell | 42/69.02 |
| 2009/0183414 | A1 | 7/2009 | Geissele | |
| 2009/0188145 | A1 * | 7/2009 | Fluhr et al. | 42/69.01 |
| 2010/0024273 | A1 | 2/2010 | Duperry et al. | |
| 2011/0099871 | A1 * | 5/2011 | Geissele | 42/69.03 |
| 2011/0167696 | A1 * | 7/2011 | Gangl | 42/69.03 |

FOREIGN PATENT DOCUMENTS

| | | |
|---|---|---|
| FR | 11763551 | 4/1959 |

* cited by examiner

*Primary Examiner* — Gabriel Klein
(74) *Attorney, Agent, or Firm* — Donald S. Holland, Esq.; Holland & Bonzagni, P.C.

(57) ABSTRACT

Applicants have disclosed an adjustable modular trigger assembly, and a related method, to avoid an unexpected firing of a long gun after an unintentional trigger pull. Applicants' preferred assembly comprises: a modular trigger housing, containing every trigger component, designed to be removably mounted within a lower firearm receiver; a trigger pull adjustment screw in a housing wall; and a sear force adjustment screw in another housing wall. During an intentional trigger pull, the shooter's finger pushes against a secondary trigger until it nestles within a slot of a non-coaxial primary trigger. Continued pulling on both triggers causes a sear to fall off a hammer notch and the firearm to discharge. In an unintentional trigger pull or jostling of the primary trigger, hooked protrusions (within the housing) of the second trigger and hammer engage to block the hammer from fully rotating, thereby avoiding discharge of the firearm.

7 Claims, 9 Drawing Sheets

ADJUSTABLE MODULAR TRIGGER ASSEMBLY FOR FIREARMS

FIELD OF INVENTION

This invention relates generally to firearms. More specifically, it relates to adjustable trigger assemblies for firearms.

BACKGROUND OF INVENTION

Trigger assemblies in firearms are often adjusted for both hunting and competitive shooting. Lighter trigger pulls (i.e., trigger pull forces for discharges) may be preferred for competition or hunting to ensure quicker or more accurate shots. Shooters often want to adjust the trigger force to their own preference, depending upon their particular application.

Some long guns, such as rifles, have come equipped for years with set screws for trigger adjustment. Turning a set screw clockwise typically increases the compression of a coil spring, which rests against a trigger stem inside a receiver housing. That creates a heavier trigger pull. Letting up on the spring, by turning the screw counterclockwise, lightens the trigger pull.

Sometimes, shooters make unauthorized and non-advisable modifications in order to lessen trigger pull force. Certain modifications can create very light trigger pull forces, but can also cause potential safety problems. Firearm manufacturers neither recommend nor sanction this approach.

Many different types of adjustable trigger assemblies have been patented, such as: U.S. Pat. No. 2,249,232 to Smith; U.S. Pat. No. 4,667,429 to Perazzi; U.S. Pat. No. 4,671,005 to Jewell; U.S. Pat. No. 4,691,461 to Behlert; U.S. Pat. No. 4,908,970 to Bell; U.S. Pat. No. 5,012,604 to Rogers; U.S. Pat. No. 5,487,233 to Jewell; U.S. Pat. No. 6,131,324 to Jewell; U.S. Pat. No. 6,164,001 to Lee; U.S. Pat. No. 6,553,706 to Gancarz et al.; U.S. Pat. No. 6,978,568 to Jewell; U.S. Pat. No. 7,047,685 to Diaz et al.; U.S. Pat. No. 7,165,352 to Langlotz; U.S. Pat. No. 8,220,193 to Lynch; and U.S. Pat. No. 8,250,799 to Duperry et al. Several of these assemblies have many small interacting parts. Small parts are difficult to manufacture properly, which can lead to jamming or delayed functioning.

Accordingly, it is a principal object of the present invention to provide an improved trigger assembly for firearms to avoid an unexpected (e.g., accidental or premature) firing after an unintentional trigger pull, where light trigger pulls have previously been set.

It is another principal object to provide a related method for avoiding an unexpected discharge of a firearm after an unintentional or accidental trigger pull, where light trigger pulls have previously been set.

It is another object to provide such an adjustable trigger assembly, commensurate with the above-listed objects, which can be part of a modular trigger assembly.

It is a more specific object to provide such an adjustable trigger assembly which is durable to use.

SUMMARY OF INVENTION

Applicants have disclosed a modular trigger assembly, and related method, for firearms such as shotguns and rifles. In the preferred embodiment, Applicants' adjustable trigger assembly comprises a modular trigger housing having: a modified standard trigger with a central elongated slot or throughbore; a second trigger pivotally mounted within the slot; a notch or shoulder, atop the first trigger, on which a sear rests during a cocked position of a hammer; and a safety means comprising two opposed hooked shaped extensions—one atop the second trigger and the other extending below a hammer—inside the firearm's housing, which interact to prevent the hammer from fully rotating after an unintentional rotation of the trigger. Both the first and second triggers are mounted on separate, non-coaxial pivot pins.

The preferred embodiment also includes: a trigger force adjustment means for adjusting the trigger pull; and a sear screw adjuster means for the manufacturer to preset the trigger pull. Both adjusters are self-contained within the housing, something not found in the prior art.

During a desired trigger pull, the shooter pulls back on both the first and second triggers. Initially, the second trigger rotates and nestles into the first trigger's slot, until the front faces of the blades for both triggers are flush. Continued pulling trips the sear off a hammer's notch to enable the hammer to fall and discharge the weapon, without the hooked extensions interfering.

If instead the first trigger is jostled accidentally, the hammer may start to rotate, whereupon the second trigger's hooked extension is designed to catch the hooked hammer's extension inside the modular housing. The firearm's trigger components subsequently must be reset to allow for a subsequent trigger pull.

Nothing is foolproof: for example, if the blades of both the first trigger and second trigger are jostled together, the firearm may discharge as though an intentional trigger pull has occurred.

BRIEF DESCRIPTION OF DRAWINGS

The above and other objects will become more readily apparent when the following description is read in conjunction with the accompanying drawings, in which.

DETAILED DESCRIPTION OF PREFERRED EMBODIMENT

Figure 9:
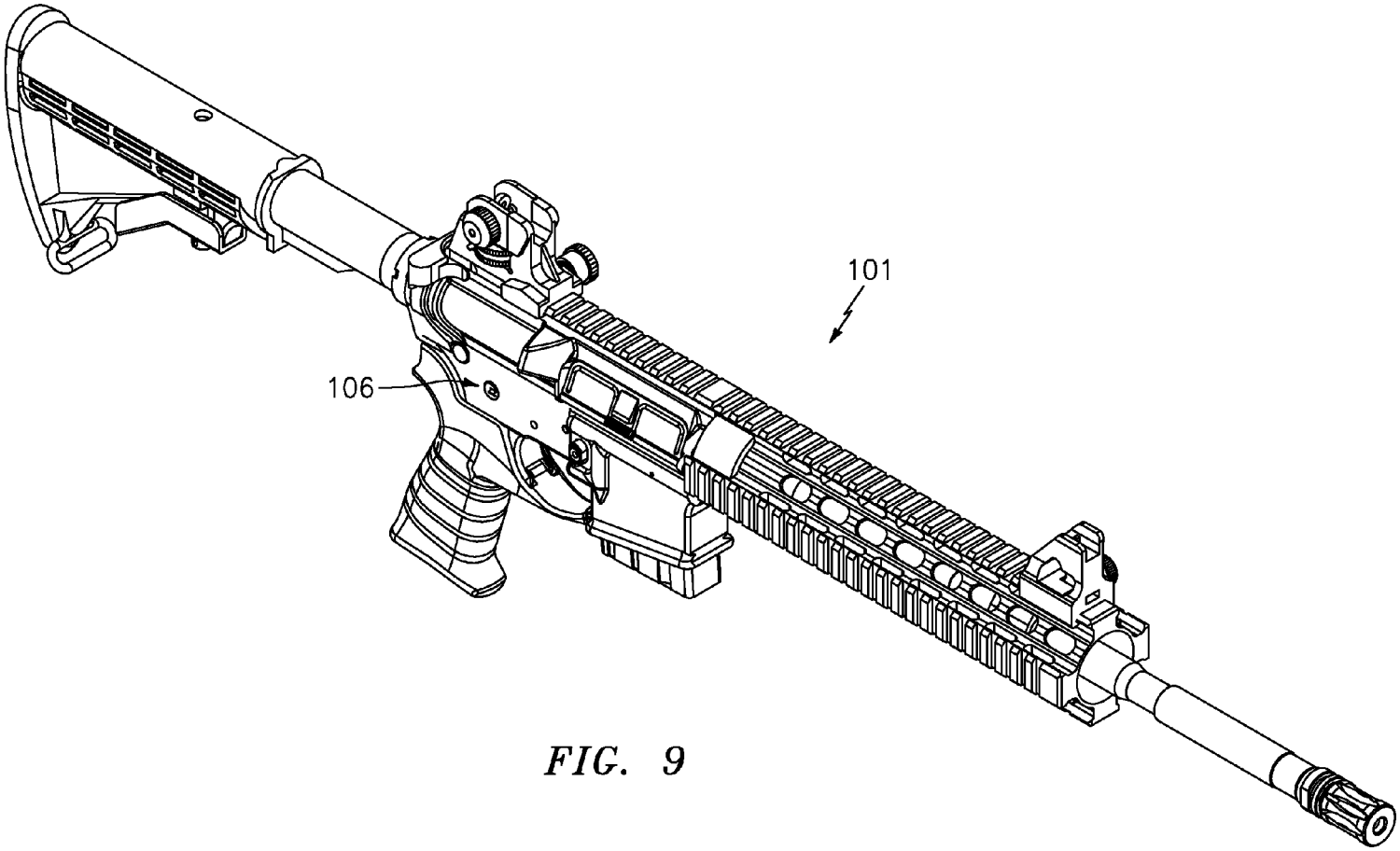
FIG. 9 is a perspective view of a semiautomatic firearm.

FIGS. 1, 2, 3, 4A, 4B, 4C, 5A, 5B, 6A, 6B, 7, 8A and 8B illustrate Applicants' preferred embodiment of an adjustable modular trigger assembly, generally designated by reference numeral 100, for a long gun, such as a semiautomatic rifle (e.g., the depicted AR-15 style semiautomatic rifle 101 in FIG. 9) or shotgun (not shown). Applicants' preferred assembly 100 comprises a modular trigger housing 102 designed to be removably mounted between the sidewalls 104*a*, 104*b* of a lower receiver 106 of the long gun by modular pins (e.g., standard trigger and hammer pins 108, 110). Note that the depicted receiver 106 is from the AR-15 style semiautomatic rifle 101.

In the preferred embodiment, the modular trigger assembly 100 has two major unique features: a trigger force adjustment means 112 (see FIGS. 1, 7) in the modular housing 102, for adjusting the trigger pull; and a safety means 114 (see FIG. 4B) for avoiding premature or inadvertent discharge of the firearm.

This application relates generally to: U.S. Pat. No. 8,220,193 to Thomas Lynch for "Method and Apparatus for Adjustable Trigger Assemblies for Firearms" issued Jul. 17, 2012; and U.S. Pat. No. 7,293,385 to Michael McCormick for "Modular Trigger Group for Firearms and Firearm Having a Modular Trigger Group" issued Nov. 13, 2007. O.F. Mossberg & Sons, Inc. ("Mossberg") is the Assignee of those patents and the current application.

Like U.S. Pat. No. 7,293,385 (though it uses different language), Applicants' module housing 102 includes two non-coaxial pivot bushings 116*a*, 116B (see FIGS. 6A, 6B), through which the hammer and trigger pins 108, 110 respectively extend, when the housing is mounted within the receiver 106. Each pivot bushing 116*a*, 116*b* extends between opposed, spaced apart, sidewalls 118*a*, 118*b* of the housing 102. Each bushing is supported at end portions within respective pair of aligned throughbores (120*a*, 120*b* and 122*a*, 122*b*) in the housing sidewalls 118*a*, 118*b*.

Pivot bushings 116*a*, 116*b* are identical. They are tubular with throughbores 124*a*, 124*b* extending longitudinally through the bushings. Each throughbore 124*a*, 124*b* exits both ends of a pivot bushing.

Figure 6A:
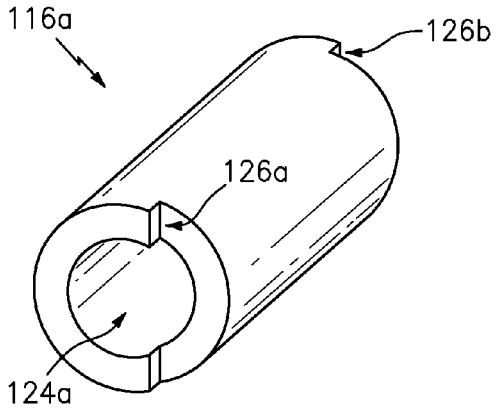
FIGS. 6A, 6B are enlarged perspective views of two identical pivot bushings shown in FIG. 1.
Figure 6B:
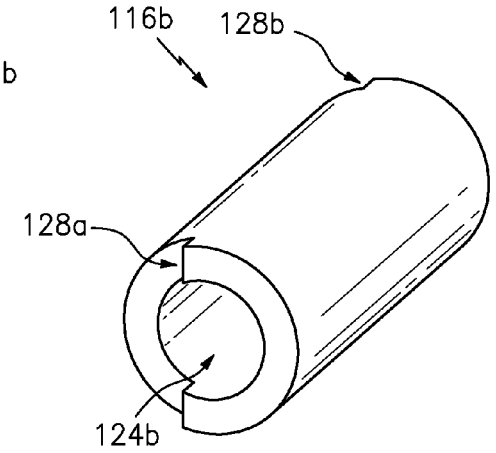

Applicants' pivot bushings 116*a*, 116*b* are preferably circular in cross-section, except their ends, which are set back to provide shoulders (see 126*a*, 126*b* and 128*a*, 128*b* in FIGS. 6A, 6B). Two hammer and trigger pin retainers 130*a*, 130*b* (see FIG. 1), located on the outside of housing sidewalls 118*a*, 118*b*, act as spring clips against the shoulders to hold the bushings 116*a*, 116*b* in place. The hammer and trigger pin retainers 130*a*, 130*b* prevent rotation of the bushings. The retainers 130*a*, 130*b* also engage radial grooves (131*a* and 131*b*; 131*c* and 131*d*) in the trigger pin 108 and hammer pin 110 to prevent those pins from moving axially.

Retainers 130*a*, 130*b* are generally each shaped like a squared upside-down "U". The tops of the retainers are indented (e.g., at 132). Those indents slip over protrusions 134*a*, 134*b* atop the housing sidewalls 118*a*, 118*b* (see FIGS. 1, 3, 5A, 5B).

As with U.S. Pat. No. 7,293,385, the modular housing 102 is mounted in receiver 106 by: (a) inserting the hammer pin 110 into a hammer hole (e.g., 136*a*) of the receiver sidewall 104*a*, then pushing the hammer pin 110 through the throughbore 124*b* of pivot bushing 116*b*, and into an aligned hammer hole (not shown) in receiver sidewall 104*b*, until both ends of the hammer pin 110 (which extend beyond the pivot bushing 116*b*) are supported by the receiver sidewalls 104*a*, 104*b*; and (b) similarly inserting the trigger pin 108 into a trigger hole (e.g., 138*a*) of the receiver sidewall 104*a*, then pushing the trigger pin 108 through the throughbore 124*a* of pivot bushing 116*a*, and into an aligned trigger hole (not shown) in the receiver sidewall 104*b*, until both ends of the trigger pin 108 (which stick out beyond the pivot bushing 116*b*) are supported by the receiver sidewalls 104*a*, 104*b*.

In other words, Applicants' modular trigger assembly contains attachment means for removably mounting the modular assembly within a lower receiver (e.g., 106) of a long gun. That attachment means comprises: the pivot bushings 116*a*, 116*b* with their throughbores 124*a*, 124*b*; and the open holes (120*a*, 120*b* and 122*a*, 122*b*) in the housing sidewalls 118*a*, 118*b*.

Applicants' preferred modular housing 102 house Applicants' trigger components, which are different than in U.S. Pat. No. 7,293,385. Applicants' preferred trigger components include: (a) a primary or first trigger 140 rotatably mounted on pivot bushing 116*a* within the housing 102 (i.e., between the housing sidewalls 118*a*, 118*b*), whereby the primary trigger 140 can pivot about that bushing 116*a* (which remains still) and (when the module housing 102 is mounted in the receiver 106) the trigger pin 108 as well; the primary trigger 140 has an elongated central slot or throughbore 142, including in its trigger blade 144; (b) a second or secondary trigger 146 rotatably mounted within the elongated central slot 142 by a trigger blade pin 148 mounted in the primary trigger 140, whereby a trigger blade 150 of the secondary trigger 146 can pivot about the trigger blade pin 148; and (c) a hammer 152, also rotatably mounted on pivot bushing 116*b* (which remains still) within the housing 102 (between the housing sidewalls 118*a*, 118*b*), whereby the hammer 152 can pivot about that bushing 116*b* and (if the housing 102 is mounted in the receiver 106) the receiver's hammer pin 110 as well.

Hammer 152 has a sear notch 154. A pivotable sear 156 is designed to catch the hammer's sear notch after the trigger components have been recocked/reset. Tension from a disconnector spring 158 biases the sear 156 toward and against the hammer notch 154 (see FIG. 4A).

Figure 1:
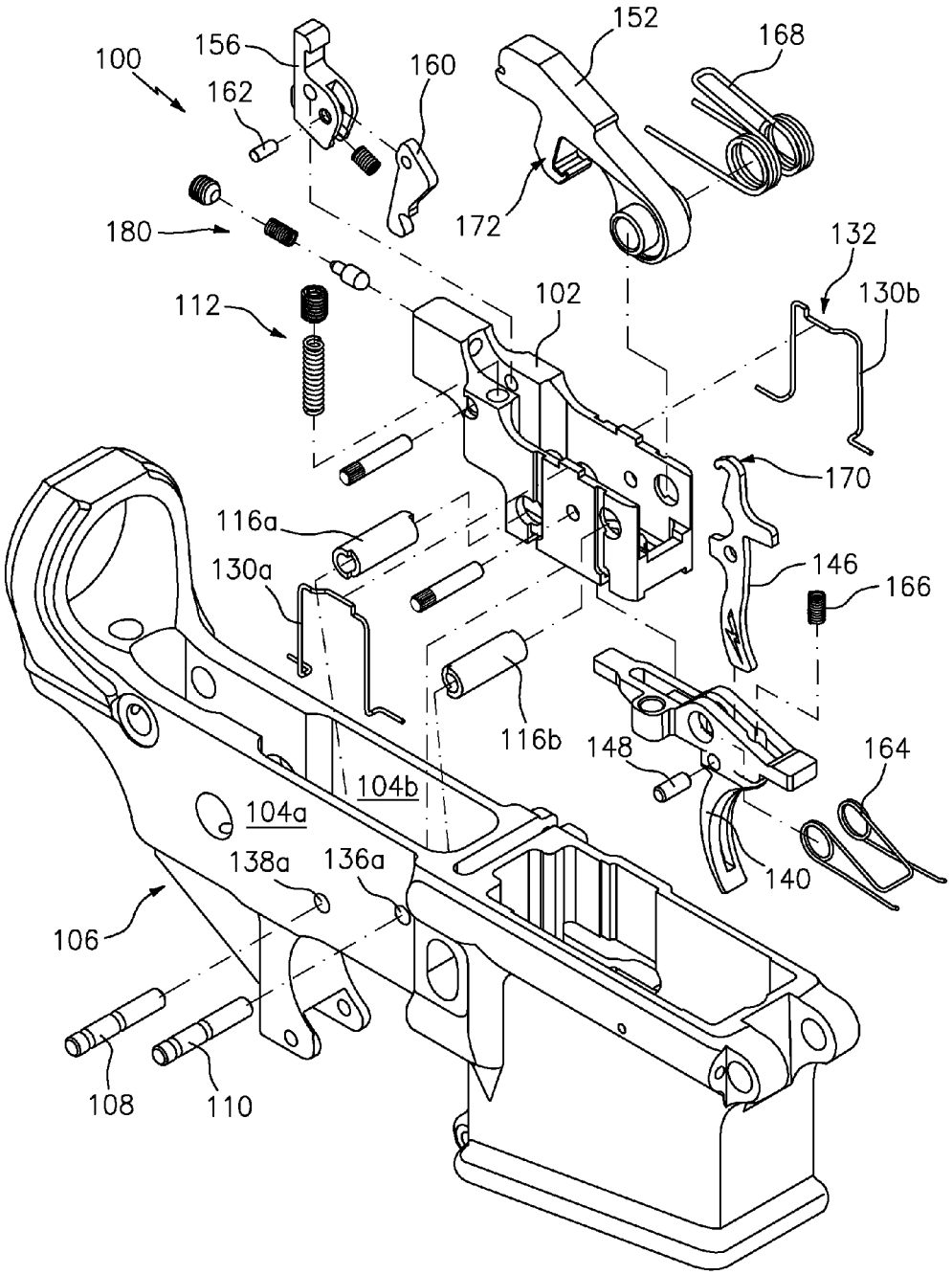
FIG. 1 is an exploded view of Applicants' preferred adjustable modular trigger assembly adjacent a lower receiver, of a semiautomatic rifle, into which the assembly can be mounted.
Figure 2:
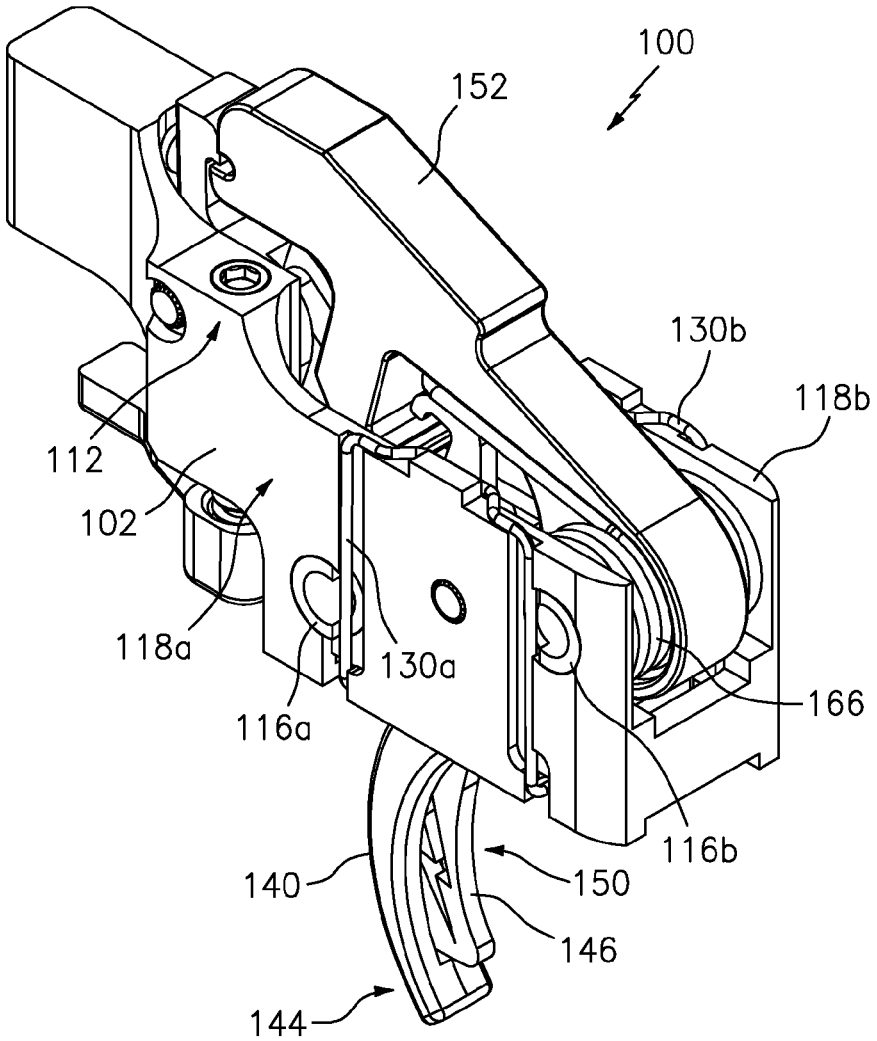
FIG. 2 illustrates a perspective view of the assembled modular trigger assembly not mounted within the lower receiver.
Figure 3:
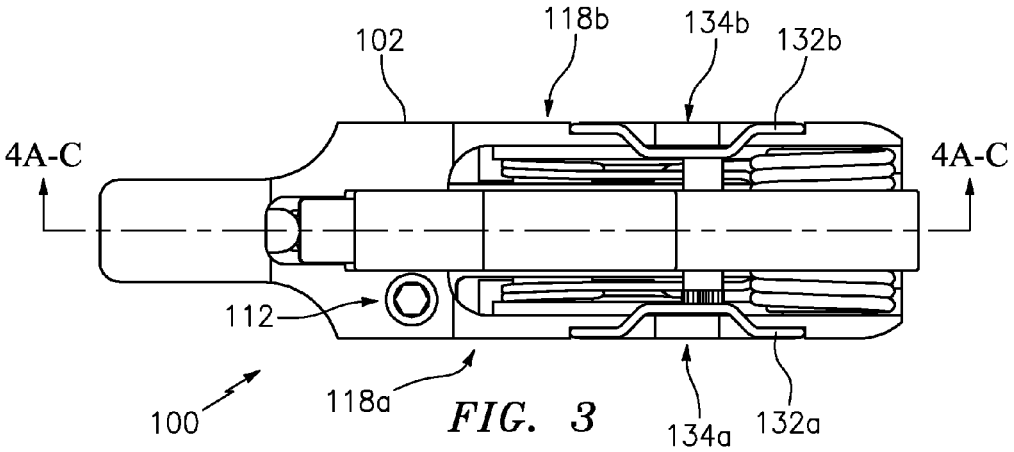
FIG. 3 is a top plan view of the assembled modular trigger assembly not mounted within the lower receiver.

As best shown in FIG. 1, other trigger assembly components in the modular housing 102 include: a disconnector 160; a disconnector pin 162; a trigger return spring 164; a trigger blade spring 166; and a hammer spring 168.

The safety means 114 for avoiding premature or inadvertent discharge of the firearm comprises: the second trigger 146, which includes a hooked protrusion 170 inside the housing 102; and an adjacent, oppositely facing, hooked protrusion 172 emanating from underneath the hammer 152.

In the case of an unintentional rotation of the first trigger 140, the sear 156 pivots out of the hammer's sear notch 154, causing the hammer 152 to start to rotate. The hooked protrusions 170, 172 engage or interlock (see FIG. 4B) to prevent the hammer 152 from fully rotating to strike a standard firing pin (not shown). This interlock prevents the firearm from accidentally discharging.

The shooter has to recock/reset the trigger components, after such an interlock, to an "at rest" position (see FIG. 4A) before the firearm can be fired. As in standard trigger assemblies, the first trigger 140 is returned to its "at rest" position by an independent trigger return spring 164 (see FIG. 1) whenever an external force is removed (e.g., finger pressure).

The above-described interlock also avoids an unexpected discharge if the blade 150 of the second trigger 146 is depressed (slightly or fully) after an unintentional partial rotation of the blade 144 of the primary trigger 146, as the movement of the primary trigger blade 144 already caused the hooked protrusions 170, 172 to engage.

Figure 4A:
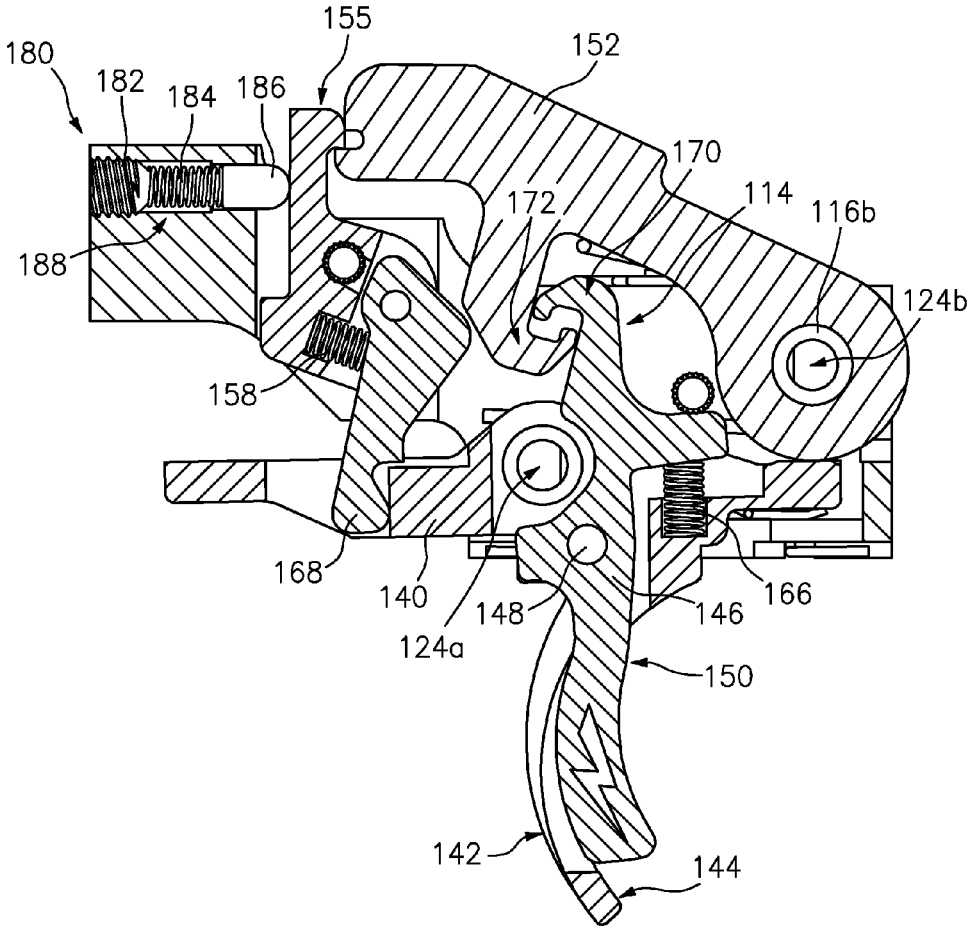
FIG. 4A is a cross-sectional view, taken along sight line 4A-4C of FIG. 3, showing the adjustable modular trigger assembly is in an "at rest" condition.
Figure 4B:
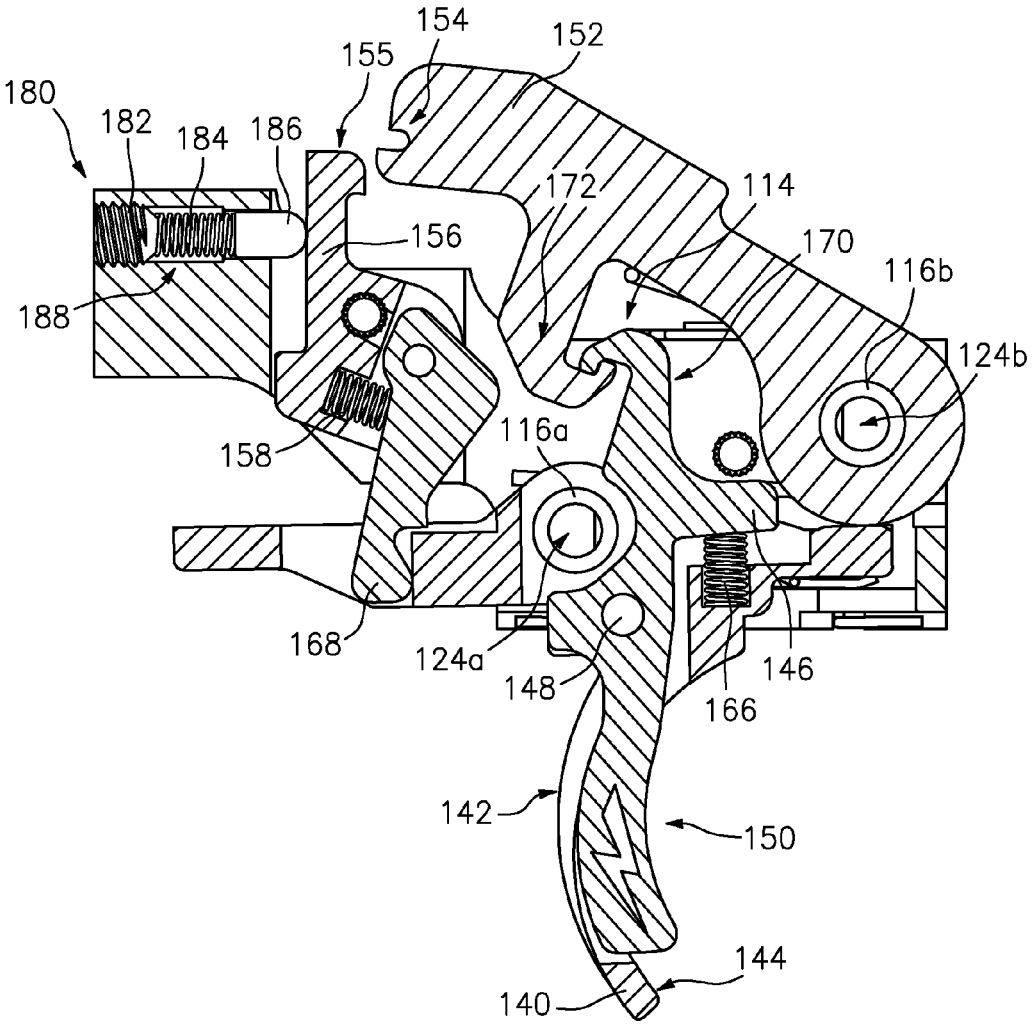
FIG. 4B is a cross-sectional view, taken along sight line 4A-4C, showing the adjustable modular trigger assembly of FIG. 4A after being at rest and an unintentional rotation of a first trigger.
Figure 4C:
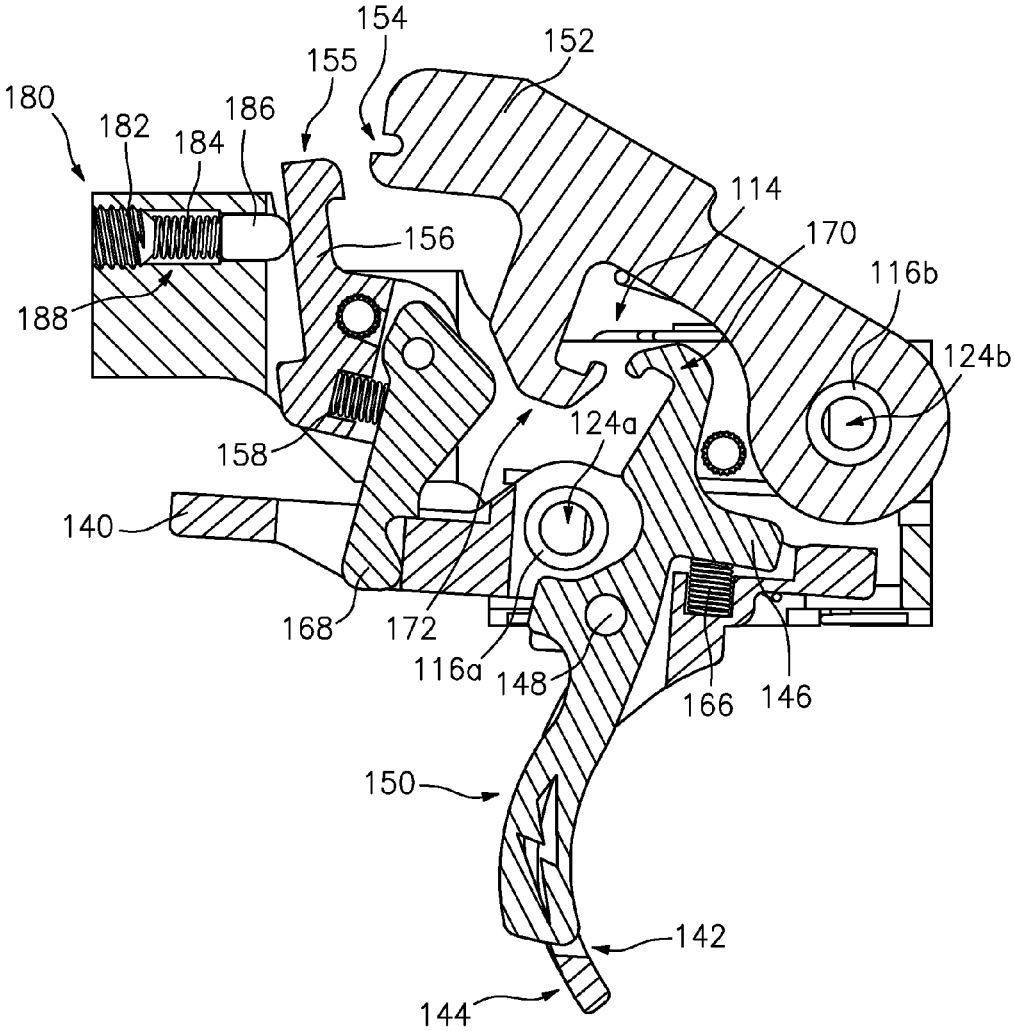
FIG. 4C is a cross-sectional view, taken along sight line 4A-4C, showing the adjustable modular trigger assembly of FIG. 4A after being at rest and an intentional full rotation of both triggers.
Figure 5A:
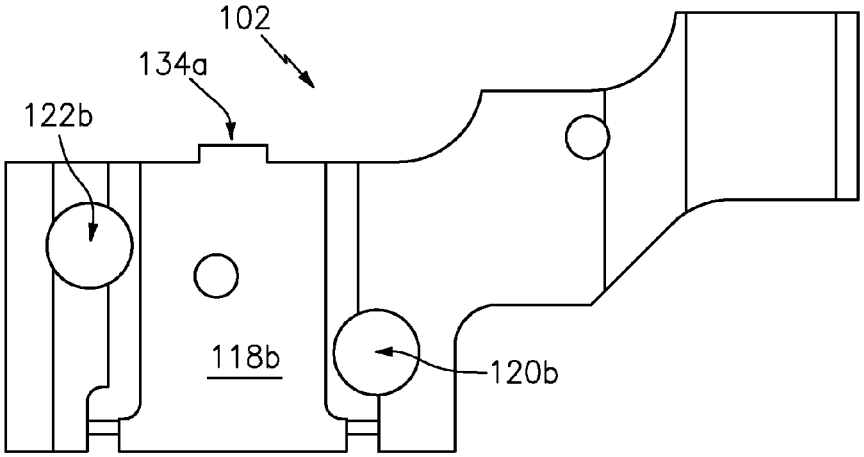
FIG. 5A is a side plan view of a modular trigger housing shown in FIG. 1.
Figure 5B:
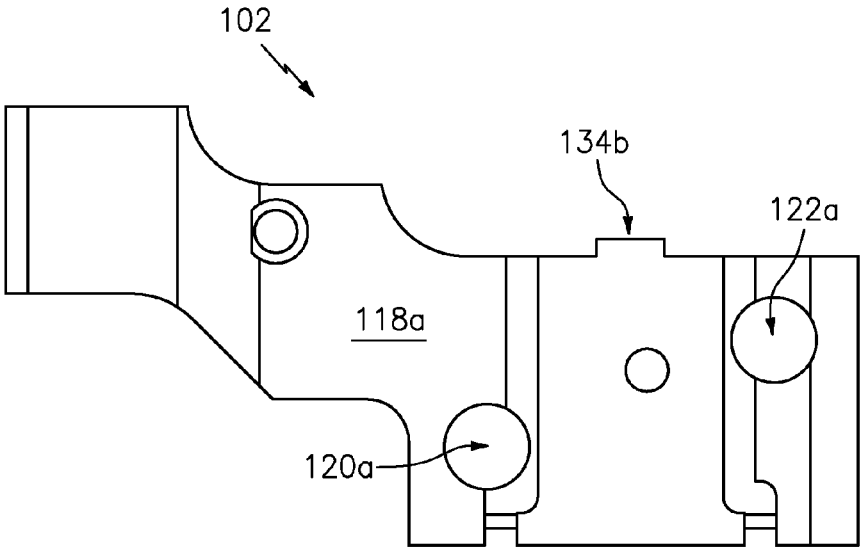
FIG. 5B is a opposite side plan view of the modular trigger housing.

During a normal, intentional trigger pull by a shooter, the exposed blade 150 of the second trigger 146 is depressed by the shooter's trigger finger (not shown) until that blade 150 is flush with the face of the primary trigger 140 (see FIG. 4C). At that point, the second trigger blade 150 has nestled within the elongated slot 142 in the first trigger blade 144. Increasing finger pressure upon the triggers 140, 146 causes both triggers to rotate. As they rotate, the sear 156 pivots out of the hammer's sear notch 154 (see FIGS. 4A, 4C), allowing the hammer 152 to fully rotate without the hooked protrusions 170, 172 interfering.

FIG. 4A shows the pivotable disconnector 160 against the first trigger 140. During the joint trigger rotation, the first trigger 140 pushes the disconnector 160 upwards, which causes the sear 156 to rotate out of the hammer's sear notch 154. That allows the hammer 152 to fall.

Figure 7:
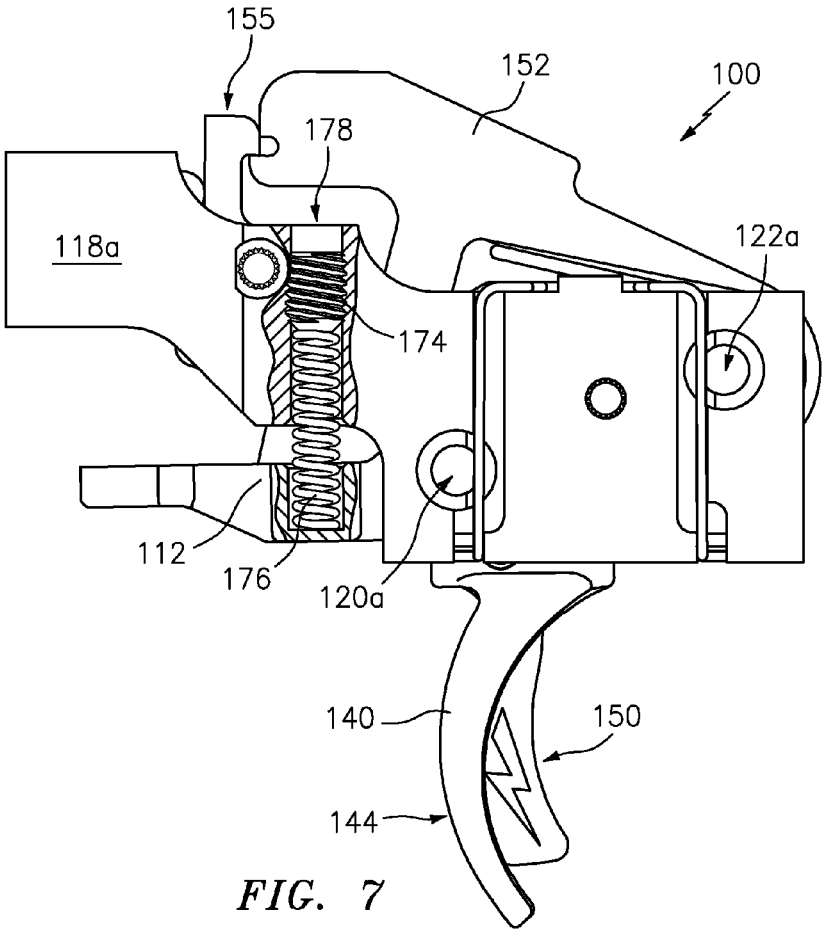
FIG. 7 is a side view of the assembled modular trigger assembly of FIG. 2, with portions broken away to show an adjustable trigger force means.
Figure 8A:
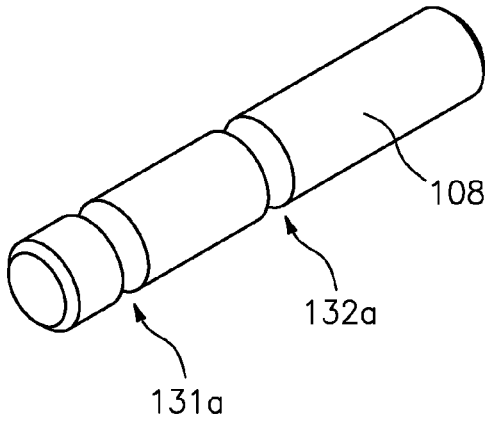
FIGS. 8A, 8B are enlarged perspective views of a hammer pin and a trigger pin shown in FIG. 1.
Figure 8B:
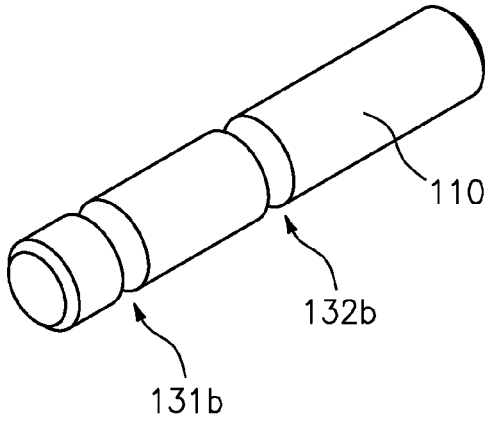

As best shown in FIGS. 1 and 7, the modular housing 102 houses the trigger force adjustment means 112 for adjusting the force required for a primary trigger pull. That trigger adjustment means comprises: a trigger force adjustment screw 174 (i.e., a set screw); and a trigger force adjustment spring 176 housed in a throughbore 178 of the housing 102. By turning the set screw 174, either clockwise or counterclockwise, the compression of associated spring 176 can be modified to adjust the trigger pull (i.e., the force required by a shooter to pull the trigger). Turning the screw 174 clockwise increases the spring tension. Conversely, the screw 174 is rotated out to decrease the spring tension.

FIGS. 1, 4A, 4B, 4C best shows a sear adjustment means 180 of Applicants' preferred modular trigger assembly 100. The sear adjustment means 180 comprises: a sear adjustment screw 182; a sear spring 184; and a sear follower 186. Those parts are housed in another throughbore 188 of the housing 102.

By turning the sear adjustment screw 182, either clockwise or counterclockwise, the compression of associated sear spring 184 can be modified to adjust the force exerted by the sear follower 186 upon the pivotable sear 156. Turning the screw 182 clockwise increases the spring tension, which presses the sear 156 tighter against the hammer's sear notch 154. That makes it harder for the sear 156 to pivot away from sear notch 154, upon the primary trigger 140 (or hammer 152) being jostled. Conversely, the sear adjustment screw 182 is rotated out to decrease the spring tension.

The preferred sear adjustment means 180 is designed for use by the manufacturer only. By turning the sear adjustment screw 182, the manufacturer: can account for slight variances (tolerances) in the size and shape of the different sear(s) 156 and hammer(s) 152 after manufacturing; and can ensure the same trigger pull for different modular trigger assembly units before they leave the manufacturer.

For example, Mossberg turns the sear adjustment screw 182 to set the trigger pull for each unit at 2.5 pounds for each unit. After adjusting the sear adjustment screw 182, Mossberg covers it with a sealant (preferably epoxy) to prevent customer adjustment.

Applicants' safety means 114 ensures the second trigger will prevent the firearm from discharging even when that trigger bounces or rotates slightly when the firearm is subjected to jarring (e.g., firearm is dropped on a hard surface).

The second trigger 146 is balanced about its pivot axis. This, coupled with its small mass and the forward bias of trigger blade spring 166, minimizes rotation. Timing does not impact the tendency of the secondary trigger to rotate when the gun is jarred.

Shooters often set their trigger assemblies for a light trigger pull. This invention is designed to avoid premature or unintended discharge at light trigger pull settings. Applicants' slotted trigger 140, pivotable second trigger blade 150, and hooked protrusions 170, 172 therefore can be thought of as avoidance means for avoiding premature or unintended discharge for light trigger pull settings in firearms.

It should be noted that Applicants' trigger assembly 100 may not be able to prevent all types of unintended or accidental discharges. For example, a heavy unbalanced force applied to the firearm or trigger(s) might override the interlock created by the hooked protrusions 170, 172; or, if both blades of triggers 140, 146 are jostled together (e.g., a tree branch snags both), that might result in a discharge as though the triggers were intentionally pulled.

Applicants' depicted modular adjustable trigger assembly 100 is designed to be installed in a standard lower receiver of an AR-style semiautomatic rifle (e.g., AR-15 or AR-10) using the existing hammer/and trigger pins 110, 108 and safety (not shown). The adjustable trigger assembly, for example, can use the standard AR-15 safety to prevent the trigger (here, double triggers 140, 146) from disengaging the hammer 152 when the AR-15's standard safety is in the "safe" position.

Applicants' invention can be thought of, in its broadest sense, as a method of avoiding a premature discharge of a long gun comprising:

a. mounting a modular trigger assembly between the sidewalls of a receiver by passing hammer and trigger pins through pivot bushings extending through a modular trigger housing of the assembly and by supporting ends of the hammer and trigger pins, which extend beyond the modular trigger assembly, within holes in the sidewalls of the receiver;
   i. wherein the modular trigger assembly includes a plurality of trigger components, rotatably mounted on the pivot bushings between sidewalls of the housing, including: a hammer; a disconnector; a first trigger and a second trigger pivotable within an elongated slot of the first trigger; and
   ii. whereby the hammer, first trigger and second trigger can rotate about and relative to the pivot bushings, which are stationary within the modular trigger assembly;
b. avoiding an unexpected discharge of the long gun, upon an unintentional partial rotation of the first trigger, by engaging a hooked protrusion of an extension of the second trigger with a hooked protrusion of the hammer to prevent the hammer from rotating further and striking a firing pin.

Applicants' preferred method can include the following step:

a. adjusting the trigger pull for the first trigger by turning a trigger force adjustment screw contained in the modular housing.

It should be understood by those skilled in making firearms that obvious structural modifications can be made to the depicted embodiment without departing from the spirit of the invention. For example, the adjustable trigger assembly 100 could be adapted for use in shotguns.

We claim:

1. A modular trigger assembly for a long gun comprising:

a. the modular trigger assembly includes a modular trigger housing containing all the trigger components of the long gun, the trigger components comprising:
   i. a primary trigger rotatably mounted between two sidewalls of the modular trigger housing on a stationary first pivot bushing, supported by the sidewalls, whereby the primary trigger can pivot about the stationary first pivot bushing;
   ii. the primary trigger has an elongated central slot in a trigger blade of the primary trigger;
   iii. a secondary trigger rotatably mounted, on a trigger blade pin, within the elongated central slot, whereby a trigger blade of the secondary trigger can pivot about the trigger blade pin and within the slot; and iv. a hammer rotatably mounted between the two sidewalls of the modular trigger housing on a second stationary pivot bushing, supported by the two sidewalls, whereby the hammer can pivot about the stationary second pivot bushing;

b. attachment means for removably mounting the modular trigger assembly, and its housed trigger components, as a single unit within a lower receiver of a long gun;

c. a sear adjustment means, housed in a first throughbore of the modular trigger housing, for presetting an amount of force required to rotate the primary trigger, the first throughbore being at least partially threaded;

d. a trigger force adjustment means, contained in the modular trigger housing, for adjusting the amount of force required to rotate the primary trigger, wherein the trigger force adjustment means comprises a set screw and a trigger force adjustment spring housed in a second throughbore of the modular trigger housing, the second throughbore being at least partially threaded; and e. a safety means, within the modular trigger housing, for avoiding an unexpected discharge of the long gun upon an unintentional jostling of the primary trigger.

2. The modular trigger assembly of claim 1 wherein the long gun is a semiautomatic rifle.

3. The modular trigger assembly of claim 1 wherein the sear adjustment means comprises a sear adjustment screw, a sear spring and a sear follower housed in the first throughbore of the modular trigger housing.

4. In a semiautomatic rifle of the type having a modular trigger assembly removably mounted between the sidewalls of a receiver by a trigger pin and a hammer pin inserted through respective pivot bushings, extending through the modular trigger assembly, with the inserted hammer pin and trigger pin being supported within aligned holes in the receiver sidewalls, the improvement comprising:

a. the modular trigger assembly comprises a modular trigger housing containing all the trigger components of the rifle, wherein the trigger components comprise:

i. a primary trigger rotatably mounted on a stationary first pivot bushing, between two sidewalls of the modular trigger housing, whereby the primary trigger can pivot about the stationary first pivot bushing and the trigger pin, which extends through the first pivot bushing;

ii. the primary trigger has an elongated central slot in a trigger blade of the primary trigger;

iii. a secondary trigger rotatably mounted, on a trigger blade pin, within the elongated central slot, whereby a trigger blade of the secondary trigger can pivot about the trigger blade pin and within the slot; and iv. a hammer rotatably mounted on a second stationary pivot bushing, between the two sidewalls of the modular trigger housing, whereby the hammer can pivot about both the stationary second pivot bushing and the hammer pin, which extends through the second pivot bushing;

b. a trigger force adjustment means, contained in the modular trigger housing, for adjusting an amount of force required to rotate the primary trigger, wherein the trigger force adjustment means comprises a set screw and a trigger force adjustment spring housed in a first throughbore of the modular trigger housing, the first throughbore being at least partially threaded; and c. a sear adjustment means, within the modular trigger housing, for presetting the amount of force at a manufacturer, wherein the sear adjustment means comprises a sear adjustment screw, a sear spring and a sear follower housed in a a second throughbore of the modular trigger housing, the second throughbore being at least partially threaded.

5. The semiautomatic rifle of claim 4 further comprising a safety means for avoiding an unexpected discharge of the rifle upon an unintentional rotation of just the primary trigger, wherein the safety means comprises a hooked protrusion of the secondary trigger blade which engages, inside the housing, an opposing hooked protrusion extending from an underside of the hammer.

6. In a semiautomatic rifle of the type having a modular trigger assembly removably mounted between two sidewalls of a receiver by a trigger pin and a hammer pin inserted through respective stationary pivot bushings, extending through the modular trigger housing, with the inserted hammer pin and trigger pin being supported within aligned holes in the receiver sidewalls, the improvement comprising:

a. the modular trigger assembly comprises a modular trigger housing containing all trigger group components of the rifle, wherein the trigger group components comprise:

i. a trigger rotatably mounted on a first stationary pivot bushing, between two sidewalls of the modular trigger housing, whereby the trigger can pivot about the first stationary pivot bushing and the trigger pin, which extends through the first stationary pivot bushing; and ii. a hammer rotatably mounted on a second stationary pivot bushing, between the two sidewalls of the modular trigger housing, whereby the hammer can pivot about the hammer pin, which extends through the second stationary pivot bushing;

b. a sear adjustment means, housed in a first throughbore of the modular trigger housing, for presetting a force required to rotate the trigger, the first throughbore being at least partially threaded; and c. a trigger force adjustment means, within the modular trigger housing, for adjusting the force required to rotate the trigger, wherein the trigger force adjustment means comprises a set screw and a trigger force adjustment spring housed in a second throughbore of the modular trigger housing, the second throughbore being at least partially threaded.

7. The semiautomatic rifle of claim 6 wherein the sear adjustment means comprises a sear adjustment screw, a sear spring and a sear follower housed in the first throughbore of the modular trigger housing.

* * * * *

UNITED STATES PATENT AND TRADEMARK OFFICE

CERTIFICATE OF CORRECTION

PATENT NO. : 9,046,313 B1
APPLICATION NO. : 14/096645
DATED : June 2, 2015
INVENTOR(S) : Lutton et al.

It is certified that error appears in the above-identified patent and that said Letters Patent is hereby corrected as shown below:

In the Claims,

In Claim 4, Column 7, line 32, after “rifle” delete “of the type”.

In Claim 6, Column 8, line 22, after “rifle” delete “of the type”.

Signed and Sealed this
Twenty-ninth Day of September, 2015

Michelle K. Lee

Michelle K. Lee
*Director of the United States Patent and Trademark Office*